US008713845B1

(12) United States Patent
Stenton

(10) Patent No.: US 8,713,845 B1
(45) Date of Patent: May 6, 2014

(54) METHOD AND APPARATUS FOR EFFICIENTLY COLLECTING RADIATION

(75) Inventor: William Conrad Stenton, Midland (CA)

(73) Assignee: Raytheon Canada Limited, Ottawa (CA)

( * ) Notice: Subject to any disclaimer, the term of this patent is extended or adjusted under 35 U.S.C. 154(b) by 956 days.

(21) Appl. No.: 11/497,902

(22) Filed: Aug. 1, 2006

(51) Int. Cl.
*F41G 1/38* (2006.01)

(52) U.S. Cl.
CPC ..... *F41G 1/38* (2013.01)
USPC ..... 42/123

(58) Field of Classification Search
USPC ..... 42/123, 131, 119, 132
See application file for complete search history.

(56) References Cited

U.S. PATENT DOCUMENTS

| | | | | |
|---|---|---|---|---|
| 3,121,163 | A | 2/1964 | Rickert | |
| 3,514,184 | A | 5/1970 | Vogl | |
| 3,552,819 | A | 1/1971 | Mandler | |
| 4,199,376 | A * | 4/1980 | Sill | 136/247 |
| 4,391,269 | A * | 7/1983 | Watson | 126/640 |
| 4,645,975 | A * | 2/1987 | Meitzler et al. | 315/82 |
| 4,710,636 | A | 12/1987 | Martino | |
| 4,743,765 | A | 5/1988 | Ekstrand | |
| 4,806,007 | A | 2/1989 | Bindon | |
| 4,981,331 | A | 1/1991 | Taylor | |
| 5,065,520 | A | 11/1991 | Shimizu et al. | |
| 5,653,034 | A | 8/1997 | Bindon | |
| 5,771,623 | A | 6/1998 | Pernstich et al. | |
| 5,903,039 | A * | 5/1999 | Bohn | 257/432 |
| 5,924,234 | A | 7/1999 | Bindon | |
| 6,031,604 | A * | 2/2000 | Pniel | 356/124 |
| 6,313,943 | B1 | 11/2001 | Ikado et al. | |
| 6,721,095 | B2 | 4/2004 | Huber | |
| 6,807,742 | B2 | 10/2004 | Schick et al. | |
| 2002/0007111 | A1 * | 1/2002 | Deckert et al. | 600/177 |
| 2002/0062856 | A1 * | 5/2002 | Wescott | 136/246 |
| 2003/0086165 | A1 | 5/2003 | Cross et al. | |
| 2004/0047586 | A1 | 3/2004 | Schick et al. | |
| 2004/0201886 | A1 | 10/2004 | Skinner et al. | |
| 2005/0252062 | A1 | 11/2005 | Scrogin et al. | |
| 2006/0231133 | A1 * | 10/2006 | Fork et al. | 136/246 |

OTHER PUBLICATIONS

Office Action mailed Jun. 2, 2009 in U.S. Appl. No. 11/923,129, filed Oct. 24, 2007.

Office Action mailed Nov. 11, 2007 in U.S. Appl. No. 11/368,850, filed Mar. 6, 2006.

U.S. Appl. No. 11/368,850, filed Mar. 6, 2006 by inventors William Conrad Stenton and Brien D. Ross for "Method and Apparatus for Using a Lens to Enhance Illumination of a Reticle", 19 pages of text, 4 pages of drawings.

(Continued)

*Primary Examiner* — Reginald Tillman, Jr.
(74) *Attorney, Agent, or Firm* — Lando & Anastasi, LLP

(57) ABSTRACT

A method and apparatus involve collection of radiation with a radiation collector that allows entry of external radiation. The exterior of the collector has mutually exclusive first, second, third and fourth surface portions oriented so that they each effect total reflection of the majority of radiation within a waveband that impinges thereon while propagating within the collector. The first and second surface portions are spaced and approximately parallel. The third and fourth surface portions extend at a first angle with respect to each other, and respectively extend at second and third angles with respect to end portions of the first and second surface portions.

21 Claims, 3 Drawing Sheets

(56) References Cited

OTHER PUBLICATIONS

U.S. Appl. No. 11/368,855, filed Mar. 6, 2006 by inventor William Conrad Stenton for "Method and Apparatus for Combining Light from Two Sources to Illuminate a Reticle", 19 pages of text, 4 pages of drawings.

U.S. Appl. No. 11/923,129, filed Oct. 24, 2007 by inventor William Conrad Stenton for "Method and Apparatus for Illuminating a Reticle", 15 pages of text, 2pages of drawings.

Office Action mailed Oct. 30, 2009 in U.S. Appl. No. 11/368,855, filed Mar. 6, 2006.

* cited by examiner

METHOD AND APPARATUS FOR EFFICIENTLY COLLECTING RADIATION

TECHNICAL FIELD OF THE INVENTION

This invention relates in general to techniques for providing illumination and, more particularly, to devices for collecting ambient radiation.

BACKGROUND OF THE INVENTION

There are various applications in which there is a need to collect radiation. As one example, a sight or scope is often mounted on a weapon to help a person aim the weapon at an intended target. Many sights superimpose a reticle on the image of the target. It can be advantageous if the reticle is illuminated. Therefore, some existing sights collect ambient radiation, and use it to illuminate the reticle. Devices have previously been developed to collect ambient radiation. Although these devices have been generally adequate for their intended purposes, they have not been completely satisfactory in all respects.

SUMMARY OF THE INVENTION

One of the broader forms of the invention involves: permitting radiation to enter a radiation collector from externally thereof, the collector having mutually exclusive first, second, third and fourth surface portions on an exterior thereof; permitting radiation within a waveband to propagate within the collector; and causing a majority of radiation within the waveband that is propagating within the collector and that impinges on any of the surface portions to be substantially total reflected, including: orienting the first and second surface portions to be spaced and extend approximately parallel to each other; orienting the third and fourth surface portions to extend at a first angle with respect to each other; orienting the third surface portion to extend at a second angle with respect to an end portion of the first surface portion, and orienting the fourth surface portion to extend at a third angle with respect to an end portion of the second surface portion.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
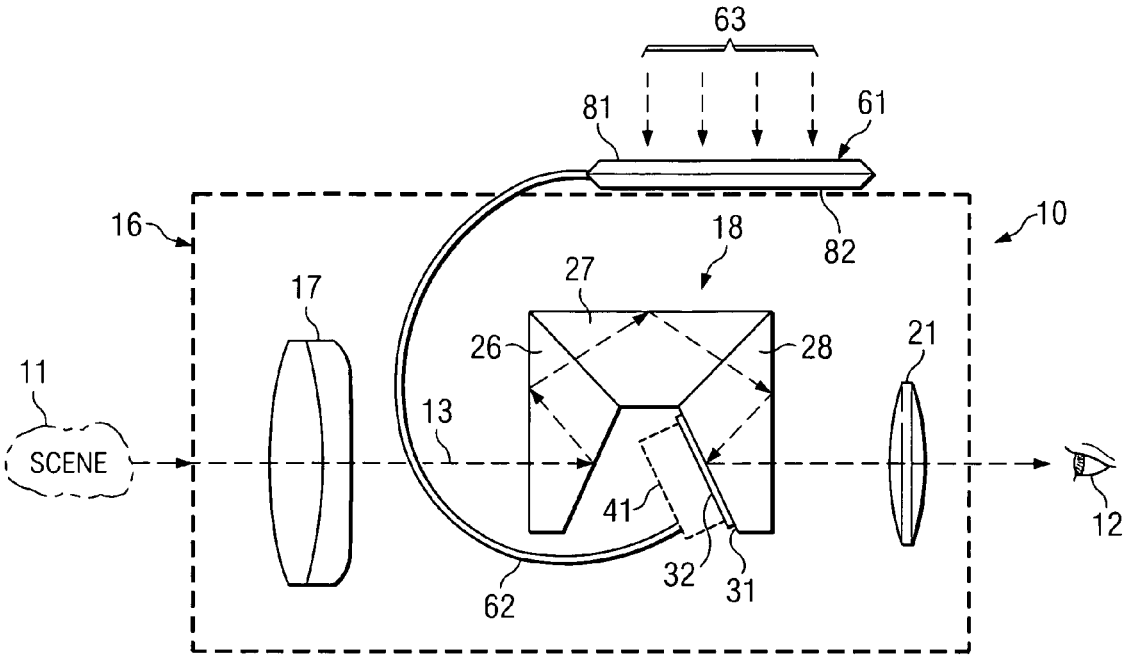
FIG. 1 is a diagrammatic view of an apparatus that is an optical sight, and that embodies aspects of the present invention.

FIG. 1 is a diagrammatic view of an apparatus that is an optical sight 10, and that embodies aspects of the present invention. The sight 10 is designed to be mounted on a not-illustrated weapon, such as a rifle or pistol. A person uses the sight 10 to accurately aim the weapon. In particular, radiation from a remote scene 11 travels through the sight 10 along a path of travel 13 to the eye 12 of the person who is using the sight.

The sight 10 has a housing that is represented diagrammatically in FIG. 1 by a broken line 16. An optical system is provided within the housing 16, and includes an objective lens 17, a prism assembly 18, and an eyepiece lens 21. When radiation from the scene 11 is traveling along the path of travel 13, it passes successively through the objective lens 17, prism assembly 18, and eyepiece lens 21. In the illustrated embodiment, the prism assembly 18 is a configuration of a known type, and includes three prisms 26, 27, and 28. The prism assembly 18 includes several prism surfaces that reflect the radiation as it travels through the prism assembly 18 along the path of travel 13. One of these surfaces is identified by reference numeral 31 in FIG. 1.

An optical coating 32 of a known type is provided on the prism surface 31. The coating 32 is reflective to visible radiation that is traveling along the path of travel 13. In a known manner, the coating 32 has at least one not-illustrated opening etched through it, in the shape of a reticle. For example, the reticle may have the form of crosshairs of a known type. The sight 10 further includes a reticle illuminating portion 41, which is represented diagrammatically in FIG. 1 by a broken line.

Figure 2:
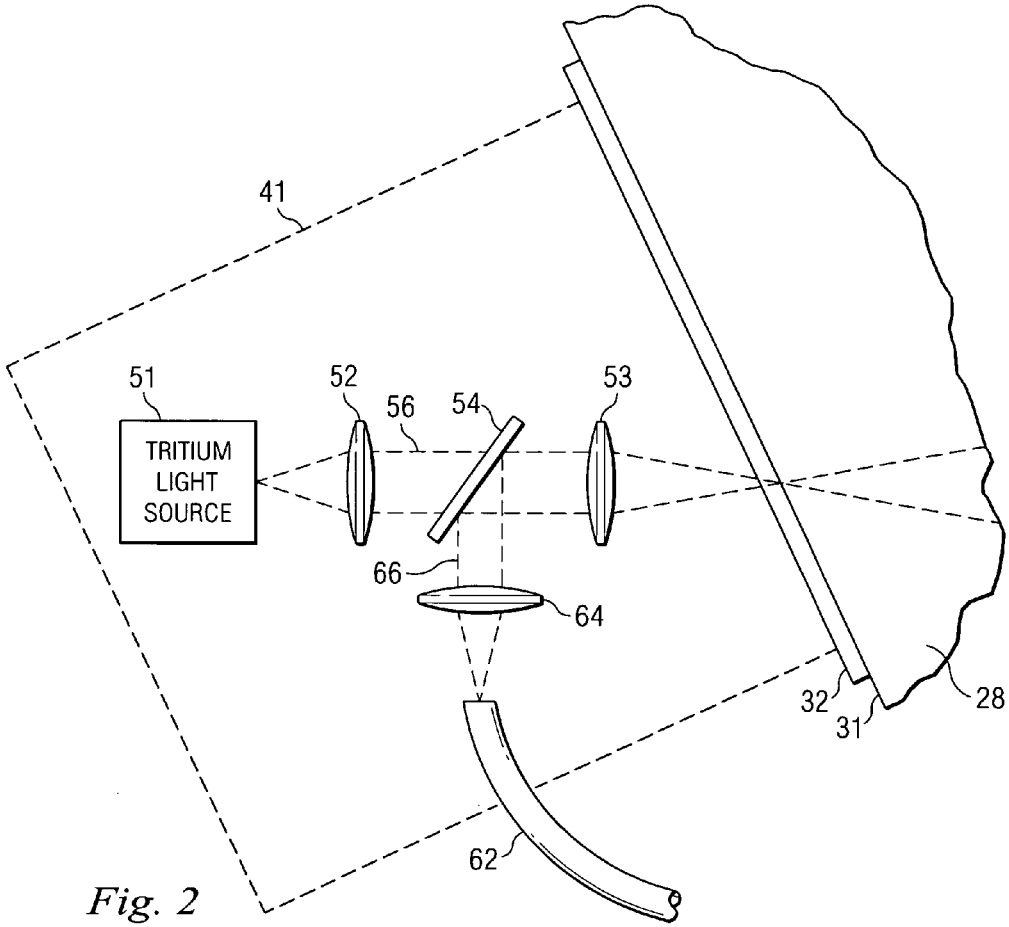
FIG. 2 is a diagrammatic view that shows a portion of FIG. 1 in an enlarged scale, and that also shows some components of the apparatus that are not visible in FIG. 1.

FIG. 2 is a diagrammatic view showing a portion of FIG. 1 in an enlarged scale, including a portion of the prism 28, a portion of the coating 32, and the internal structure of the reticle illuminating portion 41. The reticle illuminating portion 41 includes an internal light source which, in the disclosed embodiment, is a tritium light source 51. The tritium light source 51 is a radioluminescent device of a type known in the art. More specifically, tritium is a radioactive isotope of hydrogen, with atoms having three times the mass of ordinary light hydrogen atoms. The tritium material is provided within a capsule that is made from glass or some other suitable material, and that has a phosphor coating on its inner surface. As the tritium material decays, it emits soft beta rays that, when they strike the phosphor coating, are converted into visible light. The half life of tritium is approximately 12.5 years, and thus the tritium light source 51 has a usable life of more than 15 years. Consequently, the tritium light source glows continuously for a long time, thereby providing a safe and reliable source of light, without any need for a power source such as a battery.

The reticle illuminating portion 41 also includes two small lenses 52 and 53 that are supported at spaced locations. A beam splitter 54 of a known type is disposed optically between the lenses 52 and 53. The beam splitter is transmissive to radiation having one wavelength or color, and is reflective to radiation at a different wavelength or color. Light 56 emitted by the tritium light source 51 has a wavelength for which the beam splitter 54 is transmissive. Thus, the light 56 passes through the lens 52, and then some or all of this light then passes through the beam splitter 54 and the lens 53 in a direction toward the coating 32, where some of this radiation then passes through the not-illustrated opening(s) in coating 32 that define the reticle.

Referring again to FIG. 1, a radiation collector 61 is fixedly supported on the exterior of the housing 16. An optical fiber 62 of a known type extends from the radiation collector 61 to the reticle illuminating portion 41. The fiber 62 has a core that is made from a material such as polystyrene, and the core is surrounded by a cladding made from a material such as a clear acrylic. Due to differences in the refractive indexes of the cladding and core, most of the visible light within the core of the fiber is optically trapped there, and is successively reflected within the core in a manner that causes it to travel lengthwise within the core.

Ambient radiation 63 impinges on and enters the radiation collector 61. In the disclosed embodiment, the ambient radiation 63 encompasses a relatively wide range of wavelengths, including both visible light and ultraviolet light. The radiation collector 61 internally converts non-visible light (such as ultraviolet light) into visible light, in a manner discussed later. Some of the visible light from within the radiation collector 61 is then transmitted through the core of the optical fiber 62 to the reticle illuminating portion 41.

One end of the optical fiber 62 is visible in the lower portion of FIG. 2. A small lens 64 is provided between the beam splitter 54 and the illustrated end of the fiber 62. Visible light emitted from this end of the fiber 62 includes a wavelength as to which the beam splitter 54 is reflective. Consequently, this light from the fiber passes through the lens 64 and travels at 66 to the beam splitter 54, where at least part of it is reflected by the beam splitter 54. The reflected light then passes through the lens 53 and propagates toward the coating 32, where at least some of it serves to illuminate the reticle.

Figure 3:
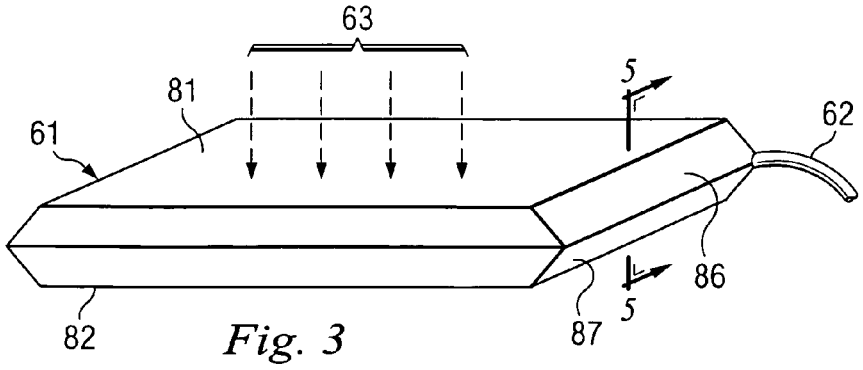
FIG. 3 is a diagrammatic perspective view showing a radiation collector and an optical fiber that are components of the embodiment of FIG. 1.
Figure 4:
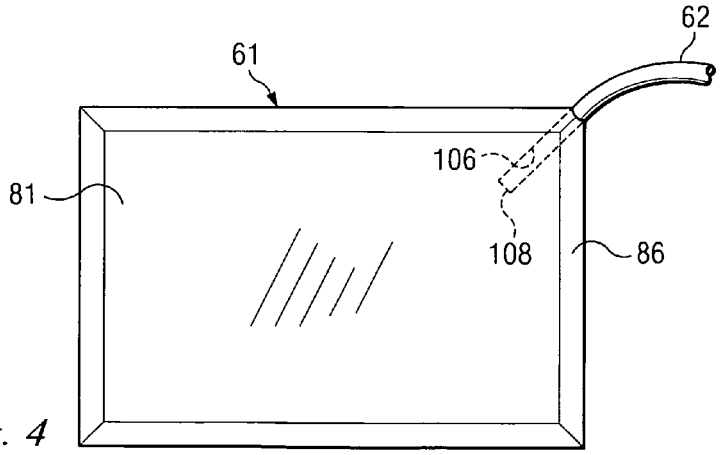
FIG. 4 is a diagrammatic top view of the structure shown in FIG. 3.

FIG. 3 is a diagrammatic perspective view of the radiation collector 61 and also an end portion of the optical fiber 62. FIG. 4 is a diagrammatic top view of the structure shown in FIG. 3. In the disclosed embodiment, the radiation collector 61 is a single integral part that is plate-like and generally rectangular. The radiation collector 61 has parallel top and bottom surfaces 81 and 82 that are polished and that are each rectangular and planar. Along each of its four edges, the radiation collector 61 has two planar edge surfaces that are polished, that extend parallel to that edge, and that converge outwardly with respect to each other. Two of these edge surfaces are designated by reference numerals 86 and 87.

Figure 5:
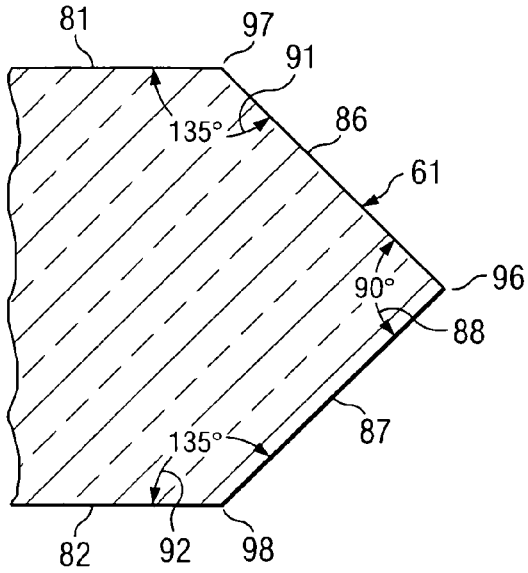
FIG. 5 is a diagrammatic fragmentary sectional view taken along the section line 5-5 in FIG. 3.

FIG. 5 is a diagrammatic fragmentary sectional view of the radiation collector 61, taken along the section line 5-5 in FIG. 3. As shown in FIG. 5, the surfaces 86 and 87 form an angle 88 of 90° with respect to each other. The surface 86 forms an angle 91 of 135° with respect to the top surface 81, and the edge surface 87 forms an angle 92 of 135° with respect to the bottom surface 82. The edge surfaces 86 and 87 intersect each other along a line 96 that extends perpendicular to the plane of FIG. 5. Similarly, the edge surface 86 intersects the top surface 81 along a line 97, and the edge surface 87 intersects the bottom surface 82 along a line 98.

In the disclosed embodiment, the radiation collector 61 is a single integral part that is made of a material such as polystyrene, and that has an index of refraction different from the indexes of refraction of almost everything adjacent to the radiation collector 61, including ambient air. Due to the differing refractive indexes, if visible radiation is propagating within the radiation collector 61 and impinges on any external surface thereof at an angle greater than what is commonly called the "critical" angle, the visible radiation will experience total internal reflection. In this regard, as is known in the art, the critical angle is measured from an imaginary reference line that is perpendicular to the surface at the point where the radiation in question impinges on the surface. The illustrated shape of the radiation collector 61, including the arrangement of external surfaces, is intended to ensure that visible radiation propagating within the radiation collector 61 will impinge on any external surface it may reach at an angle greater than the critical angle, and will therefore always experience total internal reflection. As a result, most of the visible radiation within the collector 61 will not be able to escape from the radiation collector 61 through any external surface thereof.

In addition, the material of the radiation collector 61 is doped with a special fluorescent dye of a type known in the art. When certain wavelengths of non-visible light (such as ultraviolet light) enter the radiation collector 61, the fluorescent dye absorbs that light and then emits visible light. In essence, the fluorescent dye converts the received optical energy from an initial wavelength outside the visible spectrum to a different wavelength within the visible spectrum. The material of the dye determines the wavelength and thus the color of the visible light that is emitted. The visible light produced by the fluorescent dye is then effectively trapped within the radiation collector 61, in the manner discussed above. Due to the fact that much of the visible radiation within the radiation collector 61 is not able to escape, the radiation collector 61 is relatively efficient at collecting visible radiation. In addition, to the extent that the fluorescent dye converts ultraviolet or other non-visible radiation into visible radiation, the radiation collector 61 is more efficient at collecting visible radiation than if the dye were not present. Stated differently, when the dye is present, the amount of visible radiation within the radiation collector 61 will be greater than the amount of visible radiation that enters the collector from externally thereof. thus, the radiation collector 61 effectively provides a degree of gain in regard to the collection of visible radiation.

As best seen in FIG. 4, a horizontal cylindrical opening 106 extends a short distance into the radiation collector 61 from one corner thereof. One end of the optical fiber 62 is disposed within the opening 106, and is fixedly secured there by a commercially-available adhesive, or in any other suitable manner. Visible light that is trapped within the radiation collector 61 will effectively be bouncing around therein in virtually all directions. Some of this visible radiation will enter the core of the optical fiber 62 at the end surface 108, and then will propagate through the optical fiber 62 to the reticle illuminating portion 41 (FIG. 1), in order to illuminate the reticle.

With reference to FIGS. 1-2, when the weapon sight 10 is in an environment where the ambient light includes sunlight or some other strong source of visible and/or non-visible radiation (such as ultraviolet radiation), the visible light emitted from the fiber 62 within the radiation illumination portion 61 will be significantly brighter than the light emitted by the tritium light source 51. Thus, in this type of situation, the illumination of the reticle is effected primarily by the light produced by the radiation collector 61 and transmitted through the optical fiber 62. In contrast, when the weapon sight 10 is being used in darkness or in some other environment with little or no ambient light, the optical fiber 82 will be emitting little or no visible light within the reticle illumination portion 41, but the tritium light source 51 will still be active, and will provide suitable illumination for the reticle.

Figure 6:
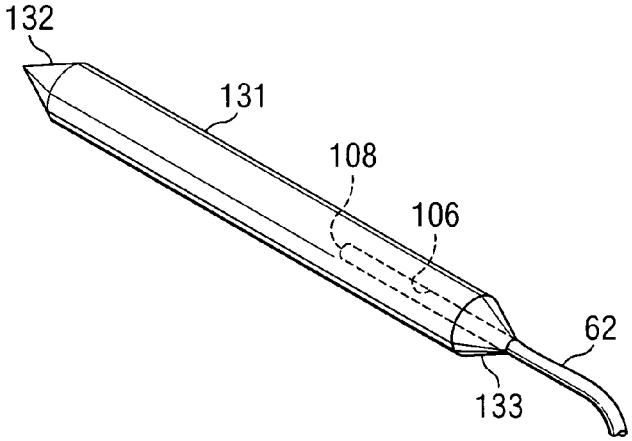
FIG. 6 is a diagrammatic perspective view of an optical fiber and a radiation collector that are an alternative embodiment of the arrangement shown in FIGS. 1-5.

FIG. 6 is a diagrammatic perspective view of the optical fiber 62 and a radiation collector 131 that is an alternative embodiment of the radiation collector in FIGS. 1-5. The radiation collector 131 is cylindrical, and has polished exterior surfaces, including a polished conical surface 132 or 133 at each end. All portions of the conical surfaces 132 and 133 extend at an angle of 45 degrees with respect to a central axis of the radiation collector 131. The cylindrical opening 106 extends a short distance coaxially into the radiation collector 131 from one end, such that the conical surface 133 is actually frustoconical rather than fully conical. An end portion of the optical fiber 62 extends into the opening 106, and is fixedly secured there by a suitable adhesive.

The radiation collector 131 is made of the same material as the radiation collector 61, and is doped with a fluorescent dye. Visible and non-visible radiation can enter the radiation collector 131 from externally thereof (including ultraviolet radiation), and the fluorescent dye will convert at least some of the non-visible radiation into visible radiation of a certain wavelength or color. As with the radiation collector 61, the arrangement of external surfaces on the radiation collector 131 (including the conical end surfaces 132 and 133) ensures that when visible radiation propagating within the collector 131 impinges on any external surface, it will do so at an angle greater than the critical angle. Consequently, most of the visible radiation within the radiation collector 131 will be effectively trapped there.

Figure 7:
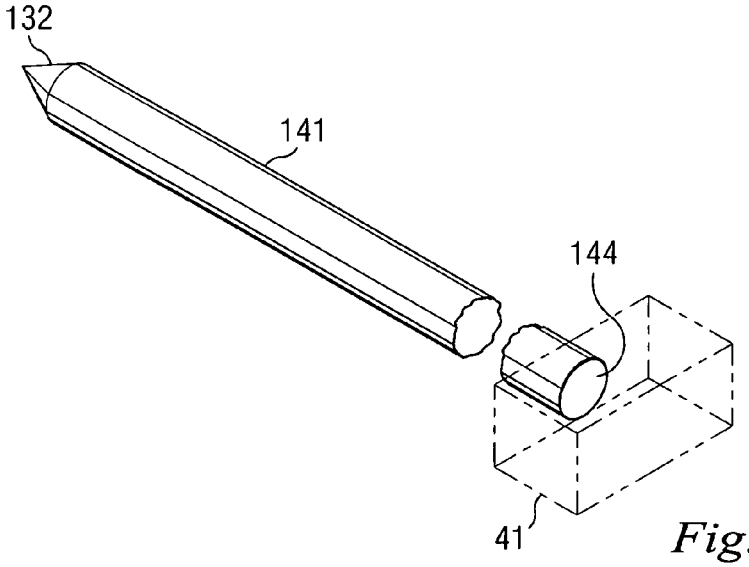
FIG. 7 is a diagrammatic perspective view of a radiation collector that is an alternative embodiment of the radiation collector shown in FIG. 6.

FIG. 7 is a diagrammatic perspective view of a radiation collector 141 that is an alternative embodiment of the radiation collector 131 of FIG. 6. The embodiment of FIG. 7 is effectively identical to the embodiment of FIG. 6, with one difference. The radiation collector 141 has the conical surface 132 at one end, but its other end extends all the way to the reticle illuminating portion 41, and has a planar end surface 144 that is perpendicular to the central axis of the radiation collector 141. When visible light that is propagating within the radiation collector 141 reaches the end surface 144, it will impinge on the surface 144 at an angle less than the critical angle. Consequently, this radiation will pass through the end surface 144 and into the reticle illuminating portion 41, where it will illuminate the reticle in a manner similar to that described earlier for the radiation 66 in FIG. 2.

Although several selected embodiments have been illustrated and described in detail, it will be understood that they are exemplary, and that a variety of substitutions and alterations are possible without departing from the spirit and scope of the present invention, as defined by the following claims.

What is claimed is:

1. An optical weapon sight including a radiation collector that allows radiation to enter thereinto from externally thereof, and that has a configuration and an index of refraction selected to permit propagation and trapping therein of radiation within a waveband, said collector being a solid block having mutually exclusive first and second surface portions and a plurality of sides on an exterior thereof, said surface portions and said sides defining an interior of said collector and each being oriented to effect substantially total internal reflection of the majority of radiation within said waveband that impinges thereon while propagating within said interior of said collector, said first and second surface portions being spaced and extending approximately parallel to each other, and each side including third and fourth surface portions, said third and fourth surface portions of each side extending at a first angle with respect to each other and extending to and intersecting each other at an imaginary line that extends approximately parallel to each of said first and second surface portions, said third surface portion of each side extending at a second angle with respect to an end portion of said first surface portion and intersecting said end portion of said first surface portion without intersecting said second surface portion, said fourth surface portion of each side extending at a third angle with respect to an end portion of said second surface portion and intersecting said end portion of said second surface portion without intersecting said first surface portion.

2. The optical weapon sight according to claim 1, wherein said first angle is approximately 90°, and said second and third angles are each approximately 135°.

3. The optical weapon sight according to claim 1, wherein said collector has an approximately platelike shape, with said parallel first and second surface portions being planar and rectangular, and said plurality of sides being outwardly tapering.

4. The firearm apparatus according to claim 3, including a radiation transmitting section that is approximately cylindrical, that has a diameter less than a distance between said sides surfaces, that extends from a remote location to an edge of said collector, and that permits propagation therein of radiation within said waveband.

5. The firearm apparatus according to claim 4, wherein said collector has an opening formed on one side of said plurality of sides that extends thereinto from said edge approximately parallel to said end portions of said first and second surface portions; and wherein said radiation transmitting section has an end portion that extends into said opening in said collector.

6. The optical weapon sight according to claim 1, wherein said collector converts radiation at a wavelength outside said waveband to radiation at a wavelength within said waveband.

7. The optical weapon sight according to claim 1, wherein said collector is a single integral part.

8. The optical weapon sight according to claim 1, including a weapon sight having:

an optical system that causes first radiation to propagate along a path of travel within said sight; and a reticle generating portion that causes second radiation representing a reticle to propagate along said path of travel with said first radiation, said reticle generating portion including a reticle illuminating portion that illuminates said reticle, said reticle illuminating portion including said collector, and including a section that causes radiation within said waveband that is propagating within said collector to be directed to a location where it illuminates said reticle.

9. A method of collecting radiation in an optical weapon sight, the method comprising:

permitting radiation to enter a radiation collector from externally thereof, said collector being a solid block having mutually exclusive first and second surface portions and a plurality of sides on an exterior thereof, each side of said plurality of sides including third and fourth surface portions;

permitting radiation within a waveband to propagate within said collector; and causing a majority of radiation within said waveband that is propagating within said collector and that impinges on any of said surface portions to be substantially totally internally reflected to trap said majority of radiation within said collector, including:

orienting said first and second surface portions to be spaced and extend approximately parallel to each other;

orienting said third and fourth surface portions of each side to extend at a first angle with respect to each other and to extend to and intersect each other at an imaginary line extending approximately parallel to each of said first and second surface portions;

orienting said third surface portion of each side to extend at a second angle with respect to an end portion of said first surface portion and to intersect said end portion of said first surface portion without intersecting the second surface portion; and orienting said fourth surface portion of each side to extend at a third angle with respect to an end portion of said second surface portion, and to intersect said end portion of said second surface portion without intersecting the first surface portion.

10. A method according to claim 9, including:

selecting said first angle to be approximately 90°; and selecting said second and third angles to each be approximately 135°.

11. A method according to claim 9, including transmitting radiation within said waveband that is propagating within said collector to a location remote from said collector.

12. A method according to claim 9, including converting radiation within said collector at a wavelength outside said waveband into radiation at a wavelength within said waveband.

13. A method according to claim 9, including:

causing first radiation to propagate along a path of travel within the optical weapon sight;

causing second radiation representing a reticle to propagate along said path of travel with said first radiation; and illuminating said reticle, including causing radiation within said waveband that is propagating within said collector to be directed to a location where it illuminates said reticle.

14. An optical weapon sight including a radiation collecting means for permitting radiation to enter thereinto from externally thereof, the radiation collecting means having an index of refraction selected for permitting radiation within a waveband to propagate and be trapped therein, said radiation collecting means including a solid block having exterior surface means for effecting substantially total internal reflection of the majority of radiation within said waveband that impinges thereon while propagating within said solid block, said exterior surface means including mutually exclusive first and second surface portions on said block, said first and second surface portions being spaced and extending approximately parallel to each other, and a plurality of side surface portions on said block, such that the first, second and side surface portions define an interior of said radiation collecting means, each side surface portion including third and fourth surface portions extending at a first angle with respect to each other- and extending to and intersecting each other at an imaginary line that extends approximately parallel to each of said first and second surface portions, said third surface portion extending at a second angle with respect to an end portion of said first surface portion, said fourth surface portion extending at a third angle with respect to an end portion of said second surface portion, said third and fourth surface portions respectively extending to and intersecting said end portions, respectively, of said first and second surface portions, said first, second, third and fourth surface portions being oriented to effect within said interior of said radiation collecting means substantially total internal reflection of the majority of radiation within said waveband.

15. The optical weapon sight according to claim 14, wherein said exterior surface means includes said first angle being approximately 90°, and said second and third angles each being approximately 135°.

16. The optical weapon sight according to claim 14, including radiation transmitting means cooperable with said radiation collecting means for transmitting radiation within said waveband that is propagating within said radiation collecting means to a location remote from said radiation collecting means.

17. The optical weapon sight according to claim 14, wherein said radiation collecting means includes means for converting radiation at a wavelength outside said waveband to radiation at a wavelength within said waveband.

18. The optical weapon sight according to claim 14, including a weapon sight having:

optical means for causing first radiation to propagate along a path of travel within said sight; and reticle generating means for causing second radiation representing a reticle to propagate along said path of travel with said first radiation, said reticle generating means including reticle illuminating means for illuminating said reticle, said reticle illuminating means including said radiation collecting means, and including means for causing radiation within said waveband that is propagating within said radiation collecting means to be directed to a location where it illuminates said reticle.

19. The optical weapon sight according to claim 1, wherein the index of refraction of said collector is greater than an index of refraction of surroundings external to said collector, and wherein said first, second and third angles are selected to cause radiation within said waveband to impinge upon any of said first, second, third and fourth surface portions within said collector at an angle of incidence greater than a critical angle of said collector so as to effect said total internal reflection of the majority of radiation within said waveband.

20. The firearm apparatus according to claim 6, wherein said collector is doped with a fluorescent dye that converts said radiation at said wavelength outside said waveband to said radiation at said wavelength within said waveband.

21. The firearm apparatus according to claim 20, wherein said waveband includes visible light.

* * * * *

UNITED STATES PATENT AND TRADEMARK OFFICE

CERTIFICATE OF CORRECTION

PATENT NO. : 8,713,845 B1
APPLICATION NO. : 11/497902
DATED : May 6, 2014
INVENTOR(S) : William Conrad Stenton It is certified that error appears in the above-identified patent and that said Letters Patent is hereby corrected as shown below:

In the Claims

At column 6, claim 4, line 9, delete "firearm apparatus" and insert --optical weapon sight--.

At column 6, claim 5, line 15, delete "firearm apparatus" and insert --optical weapon sight--.

Signed and Sealed this
Twenty-second Day of July, 2014

Michelle K. Lee

Michelle K. Lee
*Deputy Director of the United States Patent and Trademark Office*